US010008122B2

(12) United States Patent
Hardt et al.

(10) Patent No.: US 10,008,122 B2
(45) Date of Patent: Jun. 26, 2018

(54) APPARATUS TO GENERATE AIRCRAFT INTENT AND RELATED METHODS

(71) Applicant: The Boeing Company, Chicago, IL (US)

(72) Inventors: Michael W. Hardt, Madrid (ES); Francisco A. Navarro Felix, Madrid (ES)

(73) Assignee: The Boeing Company, Chicago, IL (US)

( * ) Notice: Subject to any disclaimer, the term of this patent is extended or adjusted under 35 U.S.C. 154(b) by 44 days.

(21) Appl. No.: 15/272,356

(22) Filed: Sep. 21, 2016

(65) Prior Publication Data

US 2017/0092135 A1 Mar. 30, 2017

(30) Foreign Application Priority Data

Sep. 28, 2015 (EP) ..... 15382469

(51) Int. Cl.
*G08G 5/00* (2006.01)

(52) U.S. Cl.
CPC ..... *G08G 5/003* (2013.01); *G08G 5/0017* (2013.01); *G08G 5/0095* (2013.01)

(58) Field of Classification Search
None
See application file for complete search history.

(56) References Cited

U.S. PATENT DOCUMENTS 8,744,649 B2 6/2014 Magana Casado et al.
8,977,411 B2 3/2015 Magana Casado et al.
(Continued)

FOREIGN PATENT DOCUMENTS

EP 2801963 12/2014
GB 2514226 A * 11/2014 ..... G08G 5/0095
(Continued)

OTHER PUBLICATIONS

Tarhan et al. , "Formal Intent Based Flight Management System Design for Unmanned Aerial Vehicles", International Conference on Unmanned Aircraft Systems, May 27-30, 2014, Orlando, FL, USA (Year: 2014).*
(Continued)

*Primary Examiner* — Mussa A Shaawat
*Assistant Examiner* — Abdhesh K Jha
(74) *Attorney, Agent, or Firm* — Hanley, Flight & Zimmerman, LLC

(57) ABSTRACT

Apparatus to generate aircraft intent and related methods are disclosed. An example automated aircraft intent generation method based on specifications expressed in formal languages includes: calculating first motion primitives associated with an aircraft intent description and a position of an aircraft; representing the first motion primitives in a second formal language as second motion primitives; collecting first information associated with at least one of 1) an aircraft performance model, 2) an environmental model, 3) a flight dynamic model, or 4) at least one of the first motion primitives or the second motion primitives; initializing a maneuver automaton based on the first information; collecting second information associated with at least one of: 1) flight plan instructions, 2) user preference indications, or 3) operational context indications; representing the second information as third information in a first formal language; combining the maneuver automaton and the third information to form a product automaton; determining that the product automaton satisfies a trajectory specification threshold; and in response to the product automaton satisfying the trajectory specification threshold, producing a representation of the aircraft intent description in the second formal language.

18 Claims, 3 Drawing Sheets

(56) References Cited

U.S. PATENT DOCUMENTS

| | | | | |
|---|---|---|---|---|
| 9,020,662 | B2 * | 4/2015 | Felix | G05D 1/101 701/3 |
| 9,135,828 | B2 | 9/2015 | Leones et al. | |
| 9,153,136 | B2 * | 10/2015 | Lopez Leones | G08G 5/0021 |
| 9,507,053 | B2 * | 11/2016 | Navarro | G01W 1/00 |
| 9,766,630 | B2 * | 9/2017 | Casado Magana | G05D 1/0676 |
| 2010/0305781 | A1 * | 12/2010 | Felix | G05D 1/101 701/3 |
| 2014/0336932 | A1 | 11/2014 | Leones et al. | |

FOREIGN PATENT DOCUMENTS

| | | |
|---|---|---|
| JP | 2009187416 | 8/2009 |
| WO | 2009042405 | 4/2009 |

OTHER PUBLICATIONS

U.S. Department of Defense, "Unmanned Systems Integrated Roadmap FY2013-2038," Approved for Open Publication, Reference No. 14-S-0553, retrieved on Sep. 21, 2016, 168 pages.

Wongpiromsarn et al., "Synthesis of Control Protocols for Autonomous Systems," Dec. 29, 2012, 38 pages.

Wolff et al., "Automaton-Guided Controller Synthesis for Nonlinear Systems with Temporal Logic," Intelligent Robots and Systems (IROS), 2013, 8 pages.

Baier et al., "Principles of Model Checking," MIT Press, 2008, 991 pages.

Zhao et al., "Formal Specification and Verification of a Coordination Protocol for an Automated Air Traffic Control System," Proceedings of the 12th International Workshop on Automated Verification of Critical Systems (AVoCS 2012), Electronic Communication of the EASST, vol. 53, 2012, 16 pages.

Frazzoli et al., "Maneuver-Based Motion Planning for Nonlinear Systems With Symmetries," IEEE Transactions on Robotics, vol. 21, No. 26, Dec. 2005, 15 pages.

Belta et al., "Symbolic Planning and Control of Robot Motion: Finding the Missing Pieces of Current Methods and Ideas", IEEE Robotics & Automation Magazine, Mar. 2007, 10 pages.

European Patent Office, "Invitation pursuant to Rule 63(1) EPC" issued in connection with European Patent Application No. 15382469.3, dated Apr. 14, 2016, 5 pages.

Besada et al. "Automated Aircraft Trajectory Prediction Based on Formal Intent-Related Language Processing," IEEE Trans. on Intelligent Transportation Systems, 14(3) Sep. 2013, 16 pages.

Frontera et al., "Formal Intent-Based Trajectory Description Languages," IEEE Trans. on Intelligent Transportation Systems vol:PP, Issue: 99, Feb. 2014, pp. 1-17.

Vilaplana et al. "Towards a Formal Language for the Common Description of Aircraft Intent," Proceedings of the 24th Digital Avionics Systems Conference, Washington DC, USA, Oct. 2005. Published by the Institute of Electrical and Electronic Engineers, Inc (IEEE), 16 pages.

* cited by examiner

APPARATUS TO GENERATE AIRCRAFT INTENT AND RELATED METHODS

RELATED APPLICATION

This patent claims priority to EP15382469.3, which was filed on Sep. 28, 2015. EP15382469.3 is hereby incorporated herein by reference in its entirety.

FIELD OF THE DISCLOSURE

This disclosure relates generally to apparatus to generate aircraft intent and, more particularly, to apparatus to generate aircraft intent and related methods.

BACKGROUND

Unmanned Aircraft Systems may be used to complete different tasks and/or missions. In some examples, the operator of such Unmanned Aircraft Systems is generally responsible for most of the aircraft's functionalities, such as mission planning, generating and modifying tactics and contingency management.

DESCRIPTION

Figure 1:
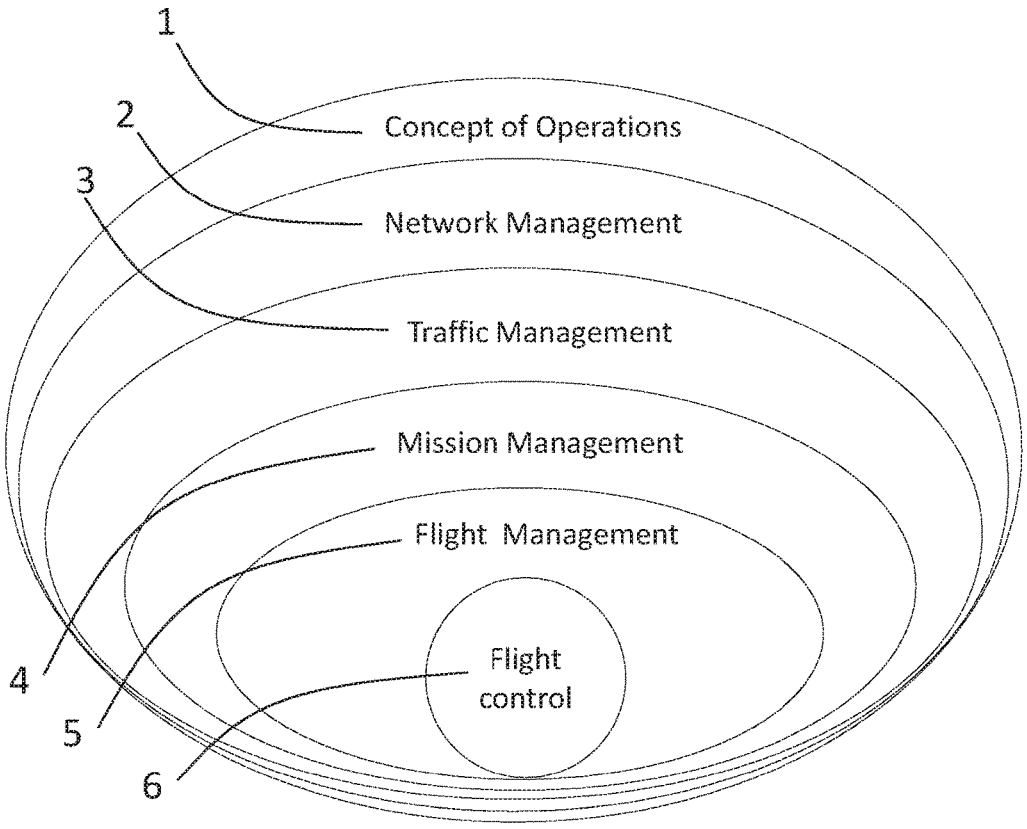
FIG. 1 shows an example structured air traffic management hierarchy for example automated processes in accordance with the teachings of this disclosure.

The examples disclosed herein relate to automated processes that combine a first formal language of flight plan indications, high-level operational constraints and/or user preferences within an example computational framework with a second formal language to facilitate real-time generation and control of autonomous flight subject to a wide range of mission, performance and/or operational constraints. The first formal language may be linear temporal logic (LTL) and the second formal language may be aircraft intent description language (AIDL). The examples disclosed herein further relate to an example apparatus and/or device to perform the example methods where the apparatus and/or device includes a controller and/or other processor and/or microprocessor.

The examples disclosed herein relate to real-time generation of trajectories and/or motion plans which enable a set of mission goals and/or objectives to be accomplished and/or respective operational constraints, user preferences, imposed flight restrictions and/or aircraft limitations.

In some examples, the representation in LTL of boundary constraints as flight plan instructions (e.g., based on mission objectives), user preference indications (e.g., based on decision criteria for different alternatives) and/or operational context indications (e.g., based on general flight rules) enable translation of the constraints and/or indications into a discrete automaton which may be processed automatically and/or combined with other computational structures.

In some examples, a flight trajectory is implemented based on an example specific aircraft performance model, an example environmental model, an example flight dynamic model and/or the previously calculated motion primitives that define the trajectory to be performed. In some examples, the results are stored and used for on-line computation for determining the aircraft intent in an efficient computational manner by an example maneuver automaton that may be combined with the discrete automaton to construct an example product automaton. In some examples, the motion plans within the product automaton enable an instance of an aircraft intent expressed in AIDL. In some examples, a performance statistic is produced and incorporated in a data base accessible to compare the quality of said performance based on the initial inputs.

The examples disclosed herein relate to an example automated computational framework for aircraft motion planning, which also considers the complexities associated with air traffic management and the device to perform the example processes.

In some examples, the methodology is based on combining the formal language of linear temporal logic (LTL) and maneuver automata or hybrid control theory, with the formal language used to describe aircraft intent, known as aircraft intent description language (AIDL). Such an example combination forms an example methodology and/or language which enables higher levels of efficiency in onboard optimization and computation and which, consequently, enables real-time generation and control of autonomous flight subject to a wide range of mission, performance and/or operational constraints.

Within the example computational framework, flight plan indications, high-level operational constraints and user preferences are represented within LTL, a formal language that has sufficient expressiveness to reflect all such constraints and/or goals and/or objectives and can process these in an automated manner. An example efficient trajectory generation framework is described that is based on AIDL constructions and that can significantly reduce the complexity of the resulting nonlinear program. In some examples, the trajectory generation uses the LTL specifications to determine valid system-wide solutions to the point-to-point steering problem. In some examples, the framework, by construction, outputs the AIDL guidance description and serves naturally as an example interface between the guidance and flight control systems.

The examples disclosed herein describe an example framework and how associated information may be stored and/or exchanged. The examples disclosed herein further relate to methods and/or systems by which example aircraft motion plans may be generated. In some examples, example aircraft motion plans may be generated and/or stored using an example mission management layer (4) and/or an example flight management layer (5) as shown in the example of FIG. 1.

The example of FIG. 1 includes various layers of an example hierarchical structure for the entire air traffic management process. In the illustrated example, the hierarchical structure includes an example concept of operations layer (1), an example network management layer (2), an example traffic management layer (3), an example mission management layer (4), and an example flight management layer (5). In the illustrated example, each layer 1, 2, 3, 4, 5, 6 organizes, optimizes and/or passes on to higher level layers associated data and/or criteria for managing air traffic.

In some examples, the ConOps (Concept of Operations) Analysis & Refinement layer (1) determines criteria to improve the performance of the entire aircraft network. In some examples, the Network Management layer (2) adjusts the aircraft flight program to adjust for supply and demand. In some examples, the Traffic Management layer (3) enables and/or substantially assures a well-distributed and planned air traffic system on a local (e.g., an airport) level, including mechanisms for decongesting and/or conflict resolution. In some examples, the Mission Management layer (4) determines the aircraft trajectory parameters that are associated with the overall mission performance. In some examples, the Flight Management layer (5) calculates the complete information describing the intended aircraft trajectory, while also providing mechanisms to manage contingencies. In some examples, the Flight Control layer (6) causes the aircraft to follow the reference trajectory or flight criteria.

In the illustrated example, each layer 1, 2, 3, 4, 5, 6 gathers and/or obtains associated data and/or criteria from the lower level layer, performs respective calculations and/or processes and/or filters the results and/or updates criteria to pass the results and/or updated criteria to the next higher level layer for a more refined calculation, getting more tactical and higher trajectory detailed information as the results and/or criteria are processed by the various layers 1, 2, 3, 4, 5, 6. In other words, in some examples, results are further refined as they are processed by the various layers 1, 2, 3, 4, 5, 6 where the concept of operations layer (1) may perform a rough and/or initial processing of the data and the flight control layer (6) may perform a detailed and/or final processing of the data.

Figure 2:
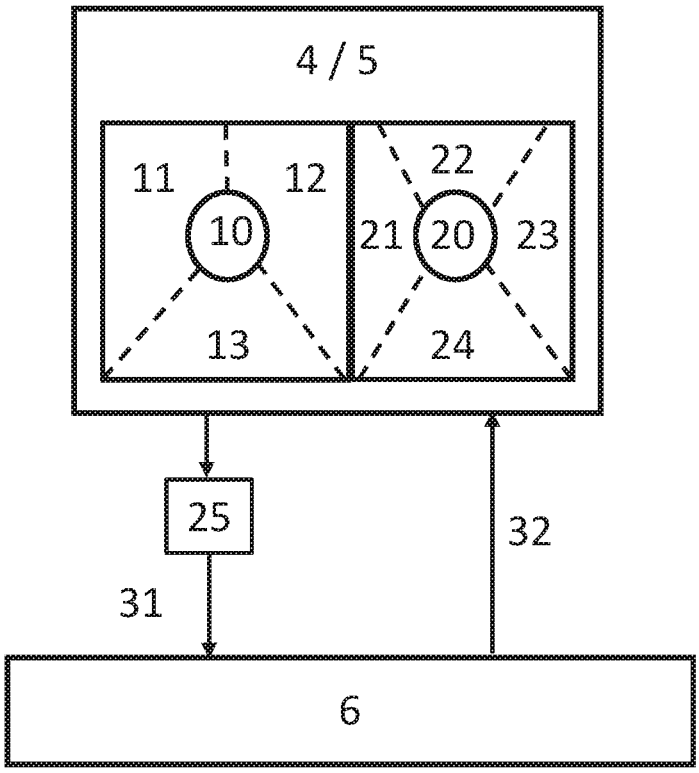
FIG. 2 shows an example automated aircraft intent generation structure in accordance with the teachings of this disclosure.

In the illustrated example, the framework described in FIG. 1 supposes the representation of these criteria in the form of an example first formal language (10) in the Mission Management layer (4) (See FIG. 2). In some examples, the first formal language is associated with linear temporal logic (LTL).

The illustrated example of FIG. 2 illustrates a more detailed view of the example mission management layer (4), the example flight management layer (5) and the example flight control layer (6). In the illustrated example, the example mission management layer (4) and/or the example flight management layer (5) includes the first formal language 10, example flight plan instructions 11, example user preference indications 12 and/or example operational context indications 13. In the illustrated example, the example mission management layer (4) and/or the example flight management layer (5) includes example maneuver automation 20, an example flight dynamic model 21, an example specific aircraft performance model 22, an example environmental model 23 and/or example motion primitives.

In some examples, the example flight plan instructions (11) include mission objectives which may include waypoints, temporal or other performance objectives; the example User preference indications (12) include decision criteria in light of different flight alternatives, safety criteria, etc. and the example Operational context indications (13) include no-fly-zones and general flight rules to be observed during various stages of a mission.

In some examples, the representation of these instructions and/or indications in a first formal language (10) enables the instructions and/or indications to be translated into a discrete automaton that may be processed automatically and/or combined with other computational structures.

In some examples, the first formal language is linear temporal logic (LTL) and the second formal language is aircraft intent description language (AIDL).

In the illustrated example, the example maneuver automation 20 includes an example flight dynamic model 21, an example specific aircraft performance model 22, an example environmental model 23 and/or example motion primitives.

In some examples, based on the specific aircraft performance model (22) and the assumptions about the environmental model (23), the examples disclosed herein calculate (e.g., calculates off-line) the associated trajectories for the motion primitives (24) of interest. In some examples, a flight trajectory may be defined if the associated trajectories for the motion primitives 24 of interest are considered in combination with the flight dynamic model (21) of an aircraft using AIDL tools. In some examples, the determined flight trajectory and/or associated results may be stored and/or used for on-line computation for determining the aircraft intent in an efficient computational manner by a maneuver automaton (20).

In some examples, the resulting maneuver automaton (20) may be combined with the discrete automaton produced by the specifications expressed in the first formal language (10) to construct and/or produce an example product automaton (25). In some examples, the resolution of the motion plans within the product automaton (25) enables correct, feasible and complete flight motions associated with and/or used to enable an aircraft intent expressed in an example second formal language (31) to be performed in the Flight Control layer (6). In some examples, a performance statistic (32) is produced and incorporated in a data base accessible to compare the quality of said performance based on the initial inputs.

The examples disclosed herein relate to real-time generation of trajectories and motion plans that fulfill a set of mission goals and/or objectives and respective operational constraints, user preferences, imposed flight restrictions and/or aircraft limitations.

Other examples mention an example computer-implemented method of generating an aircraft intent description expressed in a formal language that provides a four dimensional description of an aircraft's intended motion and configuration during a period of flight that may be specified as the three-dimensional position of the aircraft at certain moments. The example description may be the evolution of the position and other aspects of the aircraft with time.

The examples disclosed herein include a method that comprises obtaining a flight intent description corresponding to a flight plan spanning the period of flight in flight segments. In some examples, the flight intent description is parsed to provide instances of flight intent that define how the period of flight is divided into flight segments. In some examples, for each flight segment, the method includes generating an associated flight segment intent dataset that defines each of the flight segments and includes one or more instances of aircraft intent that describes the aircraft's motion and/or provides a description of the aircraft's configuration.

In some examples, the method includes an enrichment of the basic flight intent description with additional information based on user preferences, operational context and aircraft performance performed by comparing flight segment intent datasets with constraints/objectives stored in user preferences, an operational context and/or an aircraft performance database, respectively.

In some examples, constraints and/or objectives associated with the flight segment intent dataset are identified and the flight intent description is enriched with information describing the identified constraints and/or objectives. In some examples, the identified information (e.g., the enriching information) may be added as new instances of flight intent or by amending existing instances of flight intent.

In some examples, the output serves as an input for a feedback control trajectory tracking scheme. Nevertheless, in some examples, considerations for robust solutions may be made. For example, the feedback control trajectory tracking scheme may be used to establish connections using an example framework to enable the AIDL to construct the set of motion primitives (24) based on the set of different combinations of constraint threads applied to the aircraft model.

In some examples, different continuity constraints may be demanded from and/or used by the solution that give rise to different hierarchies of abstraction when the solution may be iteratively computed. In other words, depending on the inputs and/or constraints, different approaches may be iteratively computed using different hierarchical abstractions. In some examples, the difference in abstraction is why an example computational structure is considered applicable to both the Mission layer (4) and the Flight Management layer (5). For example, with regard to the mission management layer (4) (e.g., the first case), not all motion transitions may be relevant as the motion transitions have a negligible influence on overall performance factors, while the flight management layer (5) (e.g., the second case) uses, is based on and/or contemplates the complete information for a trajectory realization and/or motion transitions. The examples disclosed herein relate to computational methodologies that enable different levels of abstraction to be determined. Using the examples disclosed herein, the example computed solution is relatively accurate with respect to the specifications and realizable with respect to the aircraft dynamics.

Referring to the illustrated example of FIG. 2, the maneuver automaton (20) is based on AIDL and uses methods that reduce the complexity in the motion planning problem in the robotics field by partitioning the environment and/or introducing a discretization that reduces the complexity of the state space. In other words, in some examples, the motion planning problem may be simplified by partitioning and/or segmenting the data and/or problem to enable faster and/or more accurate calculations to take place. In some examples, when the motion dynamics are complicated and moving in dynamically changing environments, performing the discretization at the level of the controllers may be more accurate, faster and/or advantageous rather than in the environment itself. Many aircrafts such as fixed-wing aircrafts may not be holonomic (e.g. cannot fly sideways) as they are designed for symmetric flight. In examples in which an aircraft is not holonomic, the control actions are already restricted given that the aircraft may not be able to fly sideways. The examples disclosed herein further restrict the movement and/or flight patterns of an aircraft based on the AIDL constructions by describing intended flight and selecting a certain number of combinations of constraints applied to the nonlinear dynamics that define the motion and/or intended flight. Thus, using the examples disclosed herein, the combination of AIDL instructions (e.g., each combination of AIDL instructions) may be a parameterized control law that is the object of interest and that produce a finite number of motion primitives (24).

The example construction as disclosed herein is associated with the maneuver automaton (20).

Given minimal assumptions, in some examples, the symmetry of flight motion is recognized mathematically. In some examples, the motion space is reduced to a finite set of motion primitives (24) represented by trim trajectories of parameterizable duration and transition maneuvers, also parameterizable, which connect the available set of trim trajectories. In some examples, the motion space is defined as the space of all and/or some of the feasible aircraft configurations that lie within its operational envelope. The examples disclosed herein enable translations and/or rotations to be performed about the motion primitives (24) in a manner that retains and/or substantially maintains the accuracy of the solution. In some examples, the motion primitives (24) may be pieced together to achieve reachability over the desired motion space. In some examples, the problem is converted into an algebraic equation that automatically determines a solution that preserves the validity of the underlying nonlinear dynamics.

Figure 3:
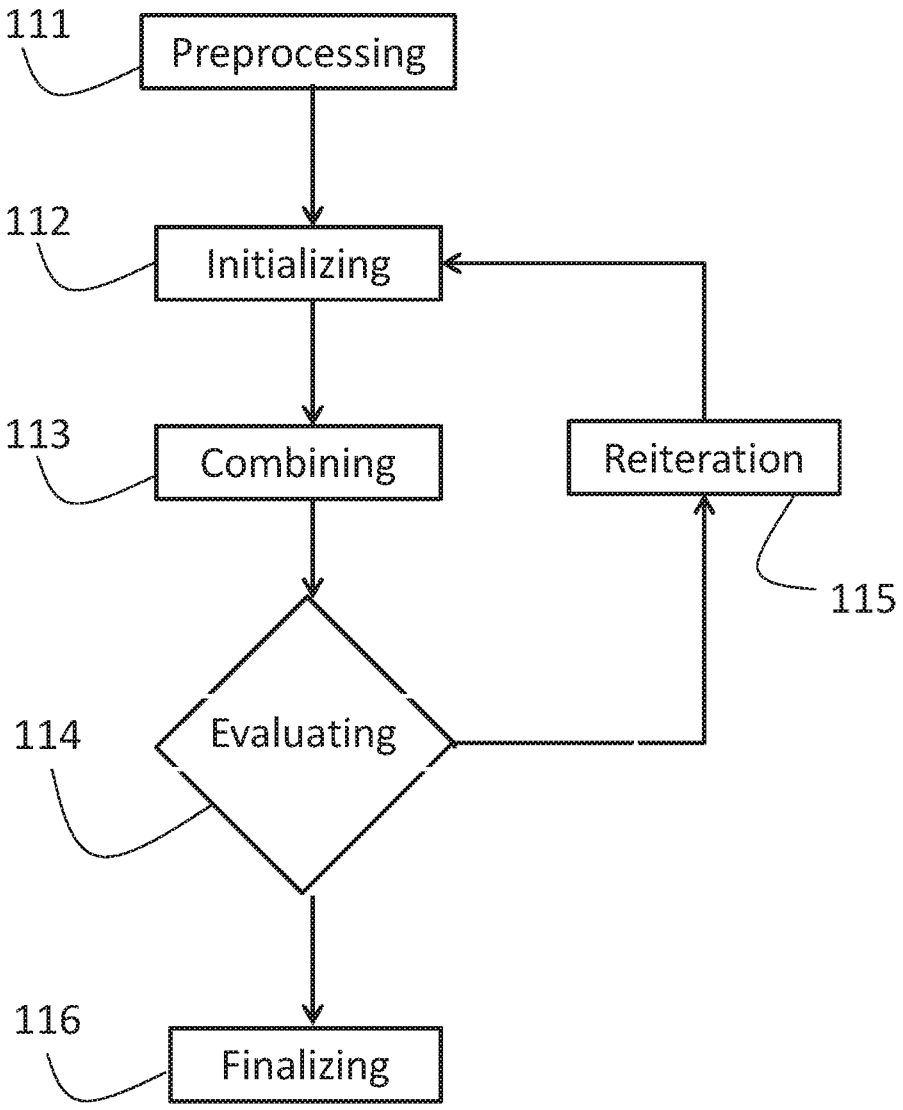
FIG. 3 shows an example automated aircraft intent generation process in accordance with the teachings of this disclosure.

The illustrated example of FIG. 3 describes an example automated aircraft intent generation process. In the illustrated example, the automated aircraft intent generation process includes preprocessing (111). In some examples, preprocessing 111 includes calculating and/or determining the motion primitives (24). In some examples, determining the motion primitives (24) includes determining a set of combinations of aircraft intent instructions of interest. In some examples, determining the motion primitives 24 includes, for a given aircraft performance model, calculating trim trajectories (e.g., those trajectories that represent a relative equilibria in which they may persist an indefinite amount of time). In some examples, determining the motion primitives (24) includes calculating transition maneuvers that bring the aircraft between one trim trajectory and another. In the illustrated example, the automated aircraft intent generation process includes initializing (112) processes. In some examples, the initializing 112 processes include initializing an example maneuver automaton with a current position (e.g., a current position of an aircraft) and introducing the motion primitives (24). In some examples, the initializing 112 processes include initializing a data structure by taking the aircraft's current position as the root node of the tree structure and adding branches using motion primitives (24) until mission goals and/or objectives are satisfied. In some examples, multiple solutions may exist that are evaluated in subsequent processes. In the illustrated example, the automated aircraft intent generation process includes combining (113) processes. In some examples, the combining (113) processes include combining the maneuver automaton with an automaton created from LTL specifications to form a product automaton (25) and finding in the new data structure the trajectory that best meets the specifications and/or satisfies a threshold. In the illustrated example, the automated aircraft intent generation process includes evaluating (114) processes that include evaluating results.

In some examples, if the result is satisfactory and/or satisfies a threshold or time is up, the analysis being performed will stop and/or end. However, in some examples, if the result is not satisfactory and/or the threshold is not satisfied, there is a reiteration (115) back from the first processes, where motion primitives (24) are used again in an incremental manner.

An example performance of the present disclosure includes planning a UAV's trajectory configured by: 1) taking off from point P, 2) performing an assigned mission including a reconnaissance of a given area, 3) returning and landing at point P.

In some examples, the initial and desired final aircraft position and velocity configurations are known. In some examples, the assigned mission includes flying continually over the given area until the projected detectable area from the aircraft has been completely covered and/or a portion of the assigned area has been covered. In some examples, after the aircraft has completely covered the assigned area and/or a portion of the assigned area has been covered, the aircraft may return.

However, in some examples, there are numerous ways (e.g., infinite manners) by which the aircraft may fulfill its objectives. In some examples, the mission and flight management 4, 5 of the aircraft deal with the information needed and/or used to perform the trajectory from two different points of view: a first point of view includes considering the design of the trajectory itself and a second point of view includes considering the system requirements that affect the aircraft.

From the first point of view, in some examples, based on considering the design of the trajectory, one among the different potential trajectories of the UAV (Unmanned Aerial Vehicle) is selected. In some examples, the selected trajectory includes taking off from point P, elevating the UAV to reach a determined height and then sweeping the area to be scanned by going to an end and returning once and again in linear parallel courses until the full area has been scanned. Then, after the full area has been scanned, return descending the UAV and landing in point P.

As an example, within the example UAV motion library, the following trim trajectories are included as shown in Table 1:

TABLE 1

| Trajectory Name | Trajectory description |
|---|---|
| [T-A] | Stationary position on ground. |
| [T-B] | Ascend at a determined ascent rate AR and flight speed FS0. |
| [T-C] | Fly straight, level course at constant speed FS1. |
| [T-D] | Turn horizontally along a circular trajectory with constant heading rate HR and flight speed FS2. |

TABLE 1-continued

| Trajectory Name | Trajectory description |
|---|---|
| [T-E] | Descend at a determined descent rate DR and flight speed FS3. |

As an example, the following example transitional maneuvers, which join the above-mentioned trim trajectories, are available as shown in Table 2:

TABLE 2

| Maneuver Name | Maneuver description |
|---|---|
| [M-AB]: | Increase flight speed and ascent rate from zero until a determined ascent rate AR and a flight speed FS0 have been reached. |
| [M-BC]: | Decrease flight altitude rate of the UAV from a determined ascent rate AR to 0, and increase flight speed from FS0 to FS1. |
| [M-CD]: | Increase heading rate of the UAV from 0 to a determined heading rate HR, and decrease flight speed from FS1 to FS2. |
| [M-DC]: | Decrease heading rate of the UAV from a determined rate HR to zero, and increase flight speed from FS2 to FS1. |
| [M-CE]: | Increase descent rate of the UAV from 0 to a determined descent rate DR, and increase flight speed from FS1 to FS3. |
| [M-EA]: | Decrease descent rate from a determined rate DR to 0, and decrease flight speed from FS3 to 0. |

As an example, the example desired trajectory may be constructed and detailed using the details of either of tables 1 and/or 2 and shown in Table 3.

TABLE 3

| Processes # | Action description | Action name |
|---|---|---|
| 1 | Position the UAV at point P. | [T-A] |
| 2 | Increase flight speed and ascent rate until reaching a determined speed FS0 and ascent rate AR. | [M-AB] |
| 3 | Ascend at a determined rate AR until a determined height H0 is reached. | [T-B] |
| 4 | Reduce ascent rate AR until reaching zero at which time a determined height H1 is reached. | [M-BC] |
| 5 | At height H1, continue in a straight, level flight with heading HEAD1 at a determined flight speed FS1 until the search area limit has been reached. | [T-C] |
| 6 | Increase heading rate of the UAV until reaching a determined heading rate HR, characterized by a determined change in heading HEADCHG1. | [M-CD] |
| 7 | Turn horizontally along a circular trajectory of a determined radius R until a change in heading HEADCHG2 is reached such that HEADCHG1 + HEADCHG2 + HEADCHG1 = 180 degrees. | [T-D] |
| 8 | Decrease heading rate of the UAV until reaching zero, characterized by a determined change in heading HEADCHG1. | [M-DC] |
| 9 | Continue with HEAD2, in opposite direction to HEAD1, at a determined flight speed FS1 until the search area limit has been reached. | [T-C] |
| 10 | Repeat processes 5 to 8 until the full projected area has been covered. | |
| 11 | Increase descent rate from 0 to a determined descent rate DR. | [M-CE] |
| 12 | Descend at a determined descent rate DR until a determined height H2 is reached. | [T-E] |
| 13 | Decrease flight speed and altitude decrease rate of the UAV until reaching ground level and the UAV has stopped. | [M-EA] |

In some examples, once motion primitives are determined and/or have been settled, they are represented in AIDL. By introducing the full sets of trim trajectories and transitional maneuvers in AIDL, in some examples, a maneuver automaton is initialized and a data structure is created with the motion primitives implemented.

From the second point of view, in some examples, the system requirements that affect the aircraft, the system requirements as specifications concerning the aircraft's flight operational envelope and mission restrictions are considered and/or are based on flight plan instructions, user preference indications and/or operational context indications.

In examples regarding the aircraft's flight operational envelope, example parameters and/or constraints include wind-relative flight velocity range, attitude and angular velocity range. In some examples, performance criteria is associated with the aircraft which imply minimizing certain criteria while selecting the flight trajectory, such as minimizing fuel consumption to maximize the available flight duration.

In examples regarding mission restrictions, examples include the total area to be scanned, the maximum vertical height above the terrain permitting a suitable detection by its onboard sensors, and ensuring that a home return is possible (e.g., always possible) should at any time the GPS signals be jammed while the aircraft is over the area to be scanned and the aircraft consequently aborts the mission. Examples associated with the mission include performance criteria such as the relation of the detectable area to the aircraft's vertical height (e.g., the higher the aircraft flies, the larger the area the aircraft may simultaneously scan) and minimizing susceptibility to flight path errors due to unknown winds. Additionally, in some examples, there may be air traffic constraints such as avoiding flying over designated no-fly zones while traveling to and from the area to be scanned and maintaining a minimum distance with any other circulating aircraft whose flight intent in the AIDL format may be received at any time by the aircraft, thus potentially requiring a replanning.

In some examples, these system requirements are represented in LTL. The LTL formalism may serve to automate the verification of the potential trajectory solutions during the search process, taking into consideration these complex high-level requirements, as well as to aid during the search itself that is typically performed using probabilistic and/or randomized search tools.

Combining the information from the maneuver automaton and the LTL specifications, a product automaton is then created.

In some examples, an evaluation is performed of the generated motion plan. The motion plan may include the search result(s) of the product automaton to confirm that it meets the problem specifications and/or satisfies a threshold. Otherwise, in some examples, a modified search is performed of the product automaton in an incremental manner possibly changing priorities of the different specifications and/or potentially relaxing their compliance if necessary or desired.

In some examples, the various levels of abstraction that AIDL offers enables a control protocol to be determined and/or found that satisfies the LTL specification, more specifically, an AIDL instance which, for higher levels of abstraction, including AIDL composites and/or ICDL (Intent Composite Description Language). At the lowest level of abstraction, in some examples, an AIDL instance is determined that includes and/or determines the flight motion (e.g., unambiguously determines the flight motion). In some examples, the use of AIDL in the control synthesis framework significantly reduces the complexity of the control search domain; thus, reducing the computational complexity for real-time onboard implementation.

The examples disclosed herein provide for greater autonomy to be achieved by UAS. The described example method for automatic synthesis of motion planning for aerial systems is scalable and interoperable due to its dependence on and/or use of AIDL.

The examples disclosed herein relate to a fully automated, generic solution involving the Mission (4) and Flight Management (5) systems and/or fully takes into consideration relevant system specifications (e.g., all relevant system specification) inherited from higher levels of the air traffic management hierarchy.

The examples disclosed relate to employing several different example techniques including applying LTL to flight and operational specifications (e.g., all flight and operational specifications) and not just ones for air traffic safety considerations.

The example maneuver automaton (20) is in the use of AIDL as the control domain for the flight dynamic model (21) of the aircraft. The examples disclosed herein enable significant computational benefits by reducing the search space. Moreover, in some examples, the nature of AIDL enables communicating the aircraft intent to other stakeholders; thus, no additional calculation may be completed once the solution is obtained.

In some examples, the computational benefits obtained aid in approaching a true real-time implementation. Thus, the examples disclosed herein may substantially increase the set of autonomous aircraft capabilities.

The examples described herein are efficient, enabling onboard real-time calculations in spite of a solution being obtained which satisfies the nonlinear dynamic model and all constraints in the case that the problem is feasible. The examples disclosed herein are robust, enabling the calculation of a solution in case the problem formulation is feasible, and otherwise providing mechanisms to determine which constraints prevent and/or deter the solution to the problem. The examples disclosed herein are dynamic, enabling monitoring and removal of constraints on-the-fly as they may arise or disappear in the context of flight. The examples disclosed herein are scalable, in the sense that the solution is not tied to one set or type of constraints nor number thereof, and AIDL in itself is a description language which is in itself conceived to be scalable for covering all flight demands for different aircraft types. The examples disclosed herein are interoperable since the output is itself AIDL, no inverse trajectory calculation need be made and the AIDL provides a minimal information format for communicating in a concise and unequivocal manner the aircraft intent to other aircraft of on-ground operators.

The examples disclosed herein significantly advance solutions directed to recognized problems and existing deficiencies in UAS. The examples disclosed herein enable modularity by calculating in real-time onboard guidance scheme, disconnected from final control implementation. The examples disclosed herein enable interoperability by determining an AIDL sequence which provides a vehicle for minimal and complete standardized exchange of guidance of information. The examples disclosed herein enable integration with manned systems given that AIDL is intended and may be equally used for aircraft traffic management for manned aircraft. The examples disclosed herein enable advanced technologies by using formal languages and discrete event controls representing state-of-the-art in robust, automated control synthesis and enables control generation and satisfaction of constraints. The examples disclosed herein enable greater automation and reduced manpower requirements. For example, the reiterated onboard processing of all high level constraints and indications enable a higher degree of automation which consequently reduces manpower requirements for UAS to, for example, supervisory tasks and realization of mission commands. The examples disclosed herein enable one operator to command multiple UAS.

The examples disclosed herein improve performance with regard to increasing consistency with high level constraints and by enabling indications of the calculated flight plans to be optimally, robustly and rapidly accomplished and/or determined.

The examples disclosed herein enable flexible use of capabilities by enabling requirements to be modified during operation. Thus, using the examples disclosed herein, motion planning may not be precomputed. By not precomputing motion planning, greater flexibility of motion capabilities may be achieved. The example AIDL structure disclosed herein may be limited in the motion capabilities it offers by essentially reducing the motion search domain thus accelerating the necessary onboard computations. The examples disclosed herein relate to autonomous aircraft motion planning and execution.

In some examples, the problem considers potentially relevant constraints, objectives and strategies that may arise in commercial and defense scenarios, computational and bandwidth limitations, with desired characteristics of modularity, interoperability and full automation.

The illustrated example of FIG. 1 illustrates a structure of the various example hierarchical levels associated with air traffic management.

Referring to FIG. 1, the numbered levels represent different levels of abstraction, a higher number implying a higher level, in which abstract, concise, discrete constraints, indications or strategies are formulated at higher levels. In the illustrated example, at lower levels, more continuous effects of the nonlinear aircraft dynamics are explicitly considered.

In the illustrated example, the three lowest levels include the example Concept of Operations (ConOps) analysis & refinement layer, the example Network Management layer and the example Traffic Management layer. In some examples, the concept of operations analysis refinement layer, the network management layer and/or the traffic management layer may be modeled using discrete models which essentially differ in their spatial and/or temporal horizons. The examples disclosed herein enable information that is exchanged between these hierarchical levels to facilitate modularity, interoperability and/or permit automated processing. In some examples, the information that is exchanged is of varied nature, and does not necessarily manifest itself as hard constraints, but may take the form of prioritized preferences, strategic goals and/or objectives or optimization criteria. Thus, the format for expressing this information must be sufficiently rich, yet also remain in a minimal, succinct format which also permits automated processing.

In the illustrated example, the three highest levels include the example Mission Management layer, the example Flight Management layer and the example Flight Control layer that deal to different degrees with the nonlinear aircraft dynamics, so that consideration of the continuous dynamic effects is addressed and/or considered, for example. In some examples, the separation of the Guidance and Control modules has multiple benefits in coding the aircraft intent (guidance information) in a minimal, standardized and/or processable format which may be communicated to the higher levels of the displayed hierarchy, as well as the lower level Flight Control. The examples disclosed herein substantially ensure coherency and correctness between all abstractions and the degree of detail of the motion plan generated on the different hierarchical levels.

The examples disclosed herein enable a standardized, complete and unambiguous information exchange format, permitting compositions and detail to substantially reduce risks and/or increase efficiency in trajectory, mission and/or traffic management. The examples disclosed herein enable coherent hierarchical abstractions of the motion plan to enable the final implemented flight trajectory to resemble as much as possible and/or to be within a threshold of the motion plan at higher levels, thus permitting and/or enabling on a large-scale system, prediction and/or organization. The examples disclosed herein enable efficient computational methods on lower hierarchical levels to enable real-time embedded onboard processing, even on small aircraft such as Unmanned Aircraft Systems (UAS). The examples disclosed herein create the processes and/or building blocks to enable higher levels of autonomy in the mentioned UAS. The examples disclosed herein provide an example methodology with capacity to react substantially immediately and autonomously to changing constraints and strategies, while also having capacity to possible arising conflicts within a threshold degree. As used herein, substantially, immediately takes into account processing delay.

The examples disclosed herein provide autonomous systems that perform high-level planning and decision-making while taking into consideration system properties, mission specifications and/or low-level constraints. The examples disclosed herein enable modularity by providing hierarchical separation of air traffic management framework. The examples disclosed herein enable interoperability by providing structured, standardized interfaces with data representation capable of expressing system requirements and motion plans with a threshold level of detail, while being consistent with other abstractions. The examples disclosed herein enable integration with manned systems by providing comfortable user interface both for indicating system requirements with a threshold amount of expressiveness, as well as interpreting aircraft intent motion plans with a sufficient level of detail. The examples disclosed herein enable advanced technologies by providing implementations that are relatively efficient and robust. The examples disclosed herein provide greater automation and reduced manpower requirements by providing ultimately, a computational framework with the capacity for full automation to reduce manpower requirements to supervisory tasks. The examples disclosed herein provide improved performance by implementing motion plans that are consistent with high level constraints, indications and/or strategies. The examples disclosed herein provide flexible use of capabilities by providing a computational framework that is flexible to accept changing policies and system requirements on-the-fly and react accordingly.

Some example AIDL tools offer a formalized description language which may express the aircraft's intent or motion plan at varying levels of abstraction using compositional formalisms. In some examples, expressiveness of the language is relatively high enabling the representation of a threshold amount of commercial flight plans as well as to a more limited extent the desired motion for UAS. Other example AIDL tools enable more expressiveness so that these tools may describe additional relevant motion plans. In some examples, the AIDL tools may represent a standardized data exchange format at a threshold number of levels of the air traffic management hierarchy, thus promoting interoperability, modularity, completeness and efficiency. Using example AIDL tools enable concise, succinct formatting that enables automation.

In some examples, the AIDL is a construction that provides a minimal, complete representation of shared information between hierarchical levels, uniquely defines the flight trajectory and also provides compositional tools to abstract and facilitate processing at all abstraction levels.

In some examples, the AIDL construction assigns dynamic and configuration constraints to the aircraft motion model to characterize and/or define various trim trajectories (e.g., flight equilibria) or maneuvers of short duration which serve to perform transitions between the trim trajectories. In some examples, the set of constraints define the aircraft motion given the environmental conditions. In some examples, the catalog of different combinations of AIDL constraints make up the flight repertoire of the aircraft which may be sufficiently rich given the extensive number of already defined and implemented constraints.

In some examples, using AIDL constructs for defining the motion primitives enables the associated AIDL instructions to formulate naturally the final guidance control values, which define the trajectory. In some examples, the instructions correspond with typical flight maneuvers and their format is a minimal, complete expression of the aircrafts intended trajectory. In some examples, the formulation then serves as input to the Flight Control as well as in communicating to higher levels of the air traffic management hierarchy.

In some examples and as defined herein, a motion primitive is a trajectory and all trajectories considered equivalent when subject to certain temporal and spatial transformations. In the case of aircraft, in some examples, the equivalence assumption implies several non-rigorous simplifications with respect to varying atmospheric conditions. In some examples, the concept of equivalent transformations enables one to work equally well with one trajectory as with an infinite set. In some examples, a motion primitive may be further broken down into two types: trim primitive and maneuvers, which may consequently be used to build a library for motion planning. In some examples, the first type (e.g., trim primitive) concerns steady-state motions or aircraft flight equilibria in which the aircraft controls are kept constant, and the relative wind has a constant direction with respect to the aircraft. In some examples, the time that the aircraft remains in a trim trajectory is typically left variable for planning purposes. The second type (e.g., maneuvers) includes a trajectory which takes the system from one steady-state condition to another by, for example, joining two different trim trajectory motion primitives for a fixed duration.

The examples disclosed herein relate to AIDL tools for generating aircraft intent including, for example, in the context of AIDL, the automated representation and processing of system requirements such as user preferences, operational constraints, and flight strategies.

The examples disclosed herein enable automatic synthesis of control protocols for unmanned systems that provide greater autonomy on a much higher level of abstraction than was previously possible. In some examples, the automatic synthesis of control protocols for unmanned systems are associated with the formulation of system requirements, which may take many forms such as, for example, in formal software verification languages (e.g., linear temporal logic). The examples disclosed herein enable the evaluation of motion plans automatically to verify their compliance with the system requirements. In some examples, the properties that control protocols may be synthesized automatically, which are correct-by-construction while using readily available software tools.

In some examples, these techniques to discrete state-space models and later to hybrid models are based on piecewise linear state space models. In some examples, these results are generalized to nonlinear dynamic models in which a variety of nonlinear control techniques are employed to handle the nonlinearities and the associated computational effort to deal with them.

Some examples provide an LTL model checking system, an LTL model checking method and an example LTL model checking program enabling even a person inexperienced in an LTL expression to easily confirm the LTL expression. In some examples, the LTL model checking system includes a variable value sequence set that generates a combination of certain variable value sequences of which variables included in the LTL model have values possible in a having sequence length, and an LTL model checking system determining whether the LTL model is established when the variable value sequence generated by the variable value sequence set generating means is substituted in the LTL model.

In some examples, the association with air traffic management is to occupy the void of the representation of aircraft user preferences, flight plan indications and operational context limitations also within LTL such that, using LTL as a specification formal language, they may also be processed and evaluated in an automated manner. In some examples, the use of LTL specifications is, however, limited to the automated verification of requirements in air traffic control. In some examples, the larger set of system requirements including user preferences, airline strategies and preliminary flight plans is not treated, nor is the automated generation of control protocols.

The examples disclosed herein enable the problem framework to maintain coherency and correctness between the different levels of abstraction. Some example methods for the case of aircraft motion planning include maneuver automaton where, given some basic assumptions about the underlying dynamics, symmetries are identified in the translation and rotation of precomputed nonlinear flight trajectories. In some examples, the symmetries are reduced to a number of trajectories to be reused and pieced together. In some examples, the motion planning problem, originally a highly nonlinear differential algebraic equation with boundary constraints, may be converted into an algebraic problem which can be rapidly and reliably solved in accordance with the teachings of this disclosure. Thus, in some examples, the full nonlinear problem is discretized; however, full consistency and coherency is maintained during the planning process. In some examples, the discrete algebraic construction of the motion planning process enables the discrete algebraic construction to be readily combined with the LTL specifications, which also can be translated into a discrete automaton, so that the generated control protocols (aircraft intent) are correct-by-construction according to the system specifications.

In some examples, a maneuver automaton enables the concatenation of available motion primitives in a structured manner to construct a complete trajectory of the desired characteristics. In some examples, the process may be automated using a directed graph in which the vertices represent states (e.g., trim primitives) in which the system may remain for a variable amount of time, and the edges represent maneuvers. Another name for such a construction is a finite state machine. In some examples, the automaton is associated with a set of rules which define how the vertices and edges may be connected for which there may exist multiple options. In some examples, a motion plan may be calculated from the automaton by applying a set of tools to enable the evaluation of all possible paths through the graph which satisfy the imposed restrictions and may be classified with respect to some performance criteria.

In some examples, the maneuver automaton is constructed alone from the aircraft's trajectories arising out of its flight operational envelope. In some examples, the amount of time that the aircraft remains in this trajectory is a continuous varying parameter within the automaton. In some examples, the final aircraft configuration is an algebraic function of the initial configuration and an initially unknown, constant wind. In some examples, algebraic relationship is computed previously offline and forms part of the motion library, thus avoiding repeatedly integrating highly nonlinear differential equations for each motion possibility to be explored. In some examples, performance criteria is associated with the motion primitive, such as the corresponding fuel consumption which also has an algebraic relationship with the time spent in the trajectory. In some examples, the position configuration (i.e. latitude, longitude, altitude) is freely assignable which may be used within the maneuver automaton to piece the position configuring together with other motion primitives. In some examples, the availability of a given motion primitive naturally enables the feasibility of its physical implementation so that the planning performed using the maneuver is correct-by-construction. Using the maneuver automaton as disclosed herein, one may construct feasible trajectories, as associated with the automaton as a set of rules such as that substantially ensure continuity and conformance between successive selection of motion primitives. Certain basic constraints may be represented in the maneuver automaton as well, such as not entering no-fly zones.

In some examples, the remaining performance criteria and higher level constraints take the form of LTL symbolic expressions. In some examples, LTL enable the versatile representation of hard constraints and/or spatial and temporal criteria to be optimized. In some examples, maintaining a minimum separation with other flying objects implies temporal predictions which are complex constraints on the sought trajectory. Similarly, in some examples, including a contingency return route in case of entering a degraded flight mode, such as in loss of GPS, is relatively complex as the validity of a given trajectory implies the existence of other trajectories which comply with the aircraft's degraded functionality.

In some examples, the combination of the maneuver automaton with the LTL representation of the system requirements is defined as a product automaton. In some examples, the product automaton further restricts the available set of paths through the equivalent graph framework so that all feasible solutions satisfy automatically the imposed requirements and/or threshold.

In some examples, the initial Flight Intent or general mission indications are progressively enriched to account for User Preferences & Operational Conditions via heuristic methods. That is, a set of potential solutions are generated based on previous experience for similar problems.

In some examples, a tree of potential solutions is generated, the amount of computational effort being monitored and/or minimized. In some examples, differential-algebraic solvers evaluate each potential solution, thereby performing parametric modifications or discarding an entire branch to investigate other such examples. However, this approach may be very time-consuming if a solution is not found quickly, especially if the numerous heuristics have not guessed the correct solution path.

The examples disclosed herein may not depend on heuristics because any type of heuristic introduces bias into the favored solution and involves considerable validation effort to ensure its viability. The examples disclosed herein relate to UAVs (Unmanned Aerial Vehicles) in which each mission may be one which has not been flown before, thus excluding the possibility of depending on existing heuristics. The examples disclosed herein provide a robust technique.

The examples disclosed herein relate to converting the problem into an algebraic one, as it is disclosed so that the resolution of the problem is much more efficient and much more suitable to be resolved in real-time in embedded hardware. Also, in some examples, all constraints are considered substantially simultaneously so that viable solutions are not needlessly discarded at the early stages of the computational process. As used herein, substantially simultaneously means that processing delay are taken into account.

The examples disclosed herein relate to example processes based on specifications expressed in a first formal language (e.g., LTL) and in a second formal language (e.g., AIDL) that are used to describe automated aircraft intent generation, The examples disclosed herein include the following processes: 1) calculating motion primitives associated with an aircraft intent description and with a position location of an aircraft, expressed in a second formal language, in a preprocessing procedure(s); 2) representing the motion primitives in the second formal language; 3) collecting of information based on inputs from the aircraft performance model, an environmental model, a flight dynamic model and the motion primitives from the procedure(s) mentioned in 2b); 3) initializing a maneuver automaton based on the information collected in the procedure(s) mentioned in 3c); 4) collecting information based on inputs from a flight plan instructions, a user preference indications and operational context indications; 5) representing in a first formal language, the information collected in the procedure(s) mentioned in 5e); 6) combining the maneuver automaton instructions created in the procedure(s) mentioned in 4 with the first formal language specifications represented in the procedure mentioned in 5 to form a product automaton with the trajectory that best meets a predetermined trajectory specification and/or satisfies a threshold; 7) evaluating the product automaton obtained in the procedure mentioned in 6; 8) producing a representation of a complete aircraft intent description of the generated motion plan, expressed in a second formal language, equivalent to a guidance law.

In some examples, the evaluation of the product automaton obtained includes transforming and connecting combinations of motion primitives based on a position location of an aircraft using the constructs of the product automaton to determine its overall viability and cost. In some examples, once the product automaton has been evaluated, there are two possibilities (e.g., a first result and a second result).

As a first result, in some examples, the guidance law produced by the product automaton is within a predetermined range of values. In some examples, the process is considered to be satisfactory and finalized and/or considered to satisfy a threshold.

As a second result, in some examples, the guidance law produced by the product automaton may be out of the predetermined range of values and/or may not satisfy a threshold. In this case, in some examples, the trajectory is considered not to be satisfactory and/or not satisfy a threshold, a reiteration is performed from the procedure(s) mentioned in 4) and new motion primitives are considered modified in an incremental manner.

In some examples, the processes are finalized when the guidance law produced by the product automaton is not performed within a predetermined and/or threshold time period, the processes may not be considered satisfactory and/or to not satisfy a threshold. The last trajectory obtained will then be considered to be valid.

In some examples, some or all of processes described in the disclosure are performed in real-time, so any new requirement may be implemented during operation, with no need of precomputed motion planning. In some examples, the first procedures are not performed in real-time.

The examples disclosed herein enable requirements to be modified during operation with no need of precomputed motion planning.

The disclosure also includes a device for generating automated aircraft intent that comprises a microprocessor configured to perform the example processes disclosed herein.

The example device, therefore, is configured to: collect information based on inputs from: an aircraft performance model, an environmental model, a flight dynamic model, and the precalculated motion primitives represented in a second formal language; initialize a maneuver automaton based on the information collected; collect information based on inputs from: a flight plan instructions, a user preference indications, and operational context indications; represent in a first formal language the foresaid collected information; combine the initialized maneuver automaton with the foresaid information represented in a first formal language (10) to form a product automaton with the trajectory that best meets a predetermined trajectory specification; evaluate (114) the product automaton obtained and, thereby produce a complete aircraft intent description represented in a second formal language of the generated motion plan equivalent to a guidance law.

In some examples, once an evaluation has been performed, the microprocessor is configured to stop in case the results achieved are within a predetermined range of values and/or satisfy a threshold or in case a predetermined and/or threshold time is reached, and is also configured to initialize the maneuver automaton again with incremented values of the motion primitives in case the results achieved are out of a predetermined range of values.

In some examples, the microprocessor is configured to transform and connect combinations of motion primitives based on position location of an aircraft using the constructs of the product automaton to determine its overall viability and cost and is also configured to perform operations in real time.

The disclosure also considers an aircraft comprising the device.

An example method of providing UAV real time (autonomous) capability in performing a set of mission goals and/or objectives and the method providing autonomous functionality within desired operational constraints, user preferences, imposed flight restrictions and within aircraft limitations, the method comprising: Calculating motion primitives; Initialize maneuver automation with current position and introduce motion primitives; combining the motion primitives with an air traffic management system comprising a hierarchical system including performance based operations, trajectory mission planning, traffic sequencing/scheduling, mission optimization, contingency management, trajectory execution, wherein the air traffic management hierarchical system is described using Linear Temporal Logic; evaluating and verifying results; obtaining an optimized mission plan; aircraft executing the mission plan.

An example automated aircraft intent generation method based on specifications expressed in formal languages, includes calculating motion primitives (24) associated with an aircraft intent description and with a position location of an aircraft, expressed in a second formal language (31), in a preprocessing (111); representing the motion primitives (24) in the second formal language (31); collecting of information based on inputs from: an aircraft performance model (22), an environmental model (23), a flight dynamic model (21), and the motion primitives (24) from b); initializing (112) of a maneuver automaton (20) based on the information collected in c); collecting of information based on inputs from: flight plan instructions (11), user preference indications (12), and operational context indications (13); representing in a first formal language (10) the information collected in e); combining (113) the maneuver automaton (20) in d) with the specifications expressed in the first formal language (10) represented in f) to form a product automaton (25) with the trajectory that best meets a predetermined trajectory specification, evaluating (114) the product automaton (25) obtained in g); and: producing a representation of a complete aircraft intent description of the generated motion plan expressed in a second formal language (31) and finalizing (116) the process when the results achieved after evaluating (114) are within a predetermined range of values or when a predetermined time is reached.

In some examples, when the results of the evaluating (114) process performed in h) are out of the predetermined range of values, the process further comprising reiterating (115) the process d), using motion primitives (24) modified in an incremental manner. In some examples, the evaluation of the product automaton (25) obtained includes transforming and connecting combinations of motion primitives (24) based on position location of an aircraft using the constructs of the product automaton (25) to determine its overall viability and cost. In some examples, at least some of the processes are performed in real-time. In some examples, the requirements are modified during operation, with no need of precomputed motion planning.

An example apparatus for generating automated aircraft intent characterized by comprising a microprocessor configured to calculate motion primitives (24) associated with an aircraft intent description and with a position location of an aircraft expressed in a second formal language (31). In some examples, the microprocessor is configured to: collect information based on inputs from: an aircraft performance model (22), an environmental model (23), a flight dynamic model (21), and the precalculated motion primitives (24); initialize (112) a maneuver automaton (20) based on the foresaid collected information. In some examples, the microprocessor is configured to: collect information based on inputs from: flight plan instructions (11), user preference indications (12), and operational context indications (13); represent in a first formal language (10) the foresaid collected information.

In some examples, the microprocessor is further configured to: combine (113) the initialized maneuver automaton (20) with the foresaid information represented in the first formal language (10) to form a product automaton (25) with the trajectory that best meets a predetermined trajectory specification. In some examples, the microprocessor is further configured to evaluate (114) the product automaton (25) obtained; and thereby produce a complete aircraft intent description represented in a second formal language (31) of the generated motion plan equivalent to a guidance law. In some examples, the microprocessor is further configured to stop (116) when the results achieved are within a predetermined range of values. In some examples, the microprocessor is further configured to stop (116) when a predetermined time is reached. In some examples, the microprocessor is further configured to reinitialize (112) the maneuver automaton (20) again with incremented values of the motion primitives (24) when the results achieved are out of a predetermined range of values. In some examples, the microprocessor is further configured to transform and connect combinations of motion primitives (24) based on position location of an aircraft using the constructs of the product automaton (25) to determine its overall viability and cost. In some examples, the microprocessor is further configured to perform operations in real time.

The examples disclosed herein combine LTL robotic technologies with AIDL to increase computational performance and provides for real time generation of trajectories or motion plans which fulfill a set of mission goals and/or objectives and function within operational constraints, user preferences, imposed flight restrictions and aircraft limitations.

The examples disclosed herein relate to an example method where a formal language, LTL, maneuver automatons and product automatons are used in combination with the AIDL language. In some examples, an initial situation of the aircraft and an assigned mission to be performed by the aircraft are described. In some examples, the aircraft has access to a motion library (e.g., a database) including trim trajectories and transitional maneuvers to create the motion primitives that are translated into AIDL and a maneuver automaton is created in an automated manner.

In some examples, at the same time and/or within a threshold time period, system requirements and specifications of the aircraft are considered. In some examples, the system requirements and/or specifications of the aircraft include information concerning wind speed, performance criteria and mission restrictions. In some examples, a discrete automaton is created and represented in LTL so that, together with the maneuver automaton, a product automaton is created. In some examples, an evaluation of the generated motion plan is performed to either confirm that it meets the problem specifications or perform a modified search in an incremental manner.

An example automated aircraft intent generation method based on specifications expressed in formal languages includes: calculating first motion primitives associated with an aircraft intent description and a position of an aircraft; representing the first motion primitives in a second formal language as second motion primitives; collecting first information associated with at least one of 1) an aircraft performance model, 2) an environmental model, 3) a flight dynamic model, or 4) at least one of the first motion primitives or the second motion primitives; initializing a maneuver automaton based on the first information; collecting second information associated with at least one of: 1) flight plan instructions, 2) user preference indications, and 3) operational context indications; representing the second information as third information in a first formal language; combining the maneuver automaton and the third information to form a product automaton; determining that the product automaton satisfies a trajectory specification threshold; and in response to the product automaton satisfying the trajectory specification threshold, producing a representation of the aircraft intent description in the second formal language.

In some examples, determining that the product automaton satisfies the trajectory specification threshold includes iteratively initializing the maneuver automaton based on the first information until a subsequently determined product automaton satisfies the trajectory specification threshold, the subsequently determined product automaton is determined using incrementally modified motion primitives. In some examples, determining that the product automaton satisfies the trajectory specification threshold includes evaluating the product automaton by transforming and connecting combinations of the motion primitives. In some examples, transforming and connecting the combinations of the motion primitives is based on the position of the aircraft associated with constructs of the product automaton.

In some examples, the method includes determining a cost associated with the position of the aircraft. In some examples, the method includes including determining viability of the position of the aircraft. In some examples, one or more processes disclosed herein are performed in substantially real time. In some examples, the method includes updating at least one of the first information and the second information without precomputed motion planning.

An example apparatus includes a determiner to calculate first motion primitives associated with an aircraft intent description and a position of an aircraft; a representer to represent the first motion primitives in a second formal language as second motion primitives; a collector to collect first information associated with at least one of 1) an aircraft performance model, 2) an environmental model, 3) a flight dynamic model, or 4) at least one of the first motion primitives of second motion primitives; an initializer to initialize a maneuver automaton based on the first information; the collector to collect second information associated with at least one of: 1) flight plan instructions, 2) user preference indications, or 3) operational context indications; the representer to represent the second information as third information in a first formal language; a combiner to combine the maneuver automaton and the third information to form a product automaton; the determiner to determine that the product automaton satisfies a trajectory specification threshold; and a producer to produce a representation of an aircraft intent description in the second formal language, wherein at least one of the determiner, the collector, the initializer, the representer, and the producer is implemented using a logic circuit.

In some examples, the determiner determining that the product automaton satisfies the trajectory specification threshold includes iteratively initializing the maneuver automaton based on the first information until a subsequently determined product automaton satisfies the trajectory specification threshold, the subsequently determined product automaton is determined using incrementally modified motion primitives. In some examples, the determiner determining that the product automaton satisfies the trajectory specification threshold includes evaluating the product automaton by transforming and connecting combinations of at least one of the first motion primitives or the second motion primitives. In some examples, transforming and connecting the combinations of at least one of the first motion primitives or the second motion primitives is based on the position of the aircraft associated with constructs of the product automaton. In some examples, the determiner is to determine a cost associated with the position of the aircraft.

An example non-transitory computer readable medium comprising instructions which, when executed, cause a machine to at least: calculate first motion primitives associated with an aircraft intent description and a position of an aircraft; represent the first motion primitives in a second formal language as second motion primitives; collect first information associated with at least one of 1) an aircraft performance model, 2) an environmental model, 3) a flight dynamic model, or 4) at least one of the first motion primitives or the second motion primitives; initialize a maneuver automaton based on the first information; collect second information associated with at least one of: 1) flight plan instructions, 2) user preference indications, and 3) operational context indications; represent the second information as third information in a first formal language; combine the maneuver automaton and the third information to form a product automaton; determine that the product automaton satisfies a trajectory specification threshold; and in response to the product automaton satisfying the trajectory specification threshold, produce a representation of the aircraft intent description in the second formal language.

In some examples, determining that the product automaton satisfies the trajectory specification threshold includes evaluating the product automaton by transforming and connecting combinations of the motion primitives. In some examples, the instructions, when executed, transform and connect the combinations of the motion primitives based on the position of the aircraft associated with constructs of the product automaton. In some examples, the instructions, when executed, determine a cost associated with the position of the aircraft. In some examples, the instructions, when executed, determine viability of the position of the aircraft. In some examples, the instructions, when executed, update at least one of the first information and the second information without precomputed motion planning.

The invention claimed is:

1. An automated aircraft intent generation method based on specifications represented in formal languages, comprising:

a) in a preprocessing step, calculating a set of motion primitives associated with a first aircraft intent description and a position of an aircraft based on combinations of AIDL instructions, the motion primitives including steady-state conditions or maneuvers to bring an aircraft from one steady-state condition to another;

b) representing the motion primitives in AIDL;

c) collecting information associated with at least one of 1) an aircraft performance model, 2) an environmental model, 3) a flight dynamic model, or 4) the motion primitives represented in AIDL;

d) initializing a finite state machine based on the collected information, the finite state machine being configured to concatenate motion primitives, wherein states of the finite state machine correspond to steady-state conditions and transitions between the states are defined by maneuvers;

e) collecting specifications associated with at least one of: 1) flight plan instructions, 2) user preference indications, or 3) operational context indications;

f) representing the specifications in a first formal language;

g) combining the initialized finite state machine with the specifications represented in the first formal language to obtain a trajectory that satisfies a trajectory specification threshold;

h) determining whether the obtained trajectory satisfies the trajectory specification threshold;

i) in response to determining that the obtained trajectory does not satisfy the trajectory specification threshold, iteratively initializing the finite state machine based on the information until a subsequently determined set of motion primitives satisfies the trajectory specification threshold, the subsequently determined set of motion primitives determined using incrementally modified motion primitives; and j) in response to determining that the obtained trajectory satisfies the trajectory specification threshold, producing a representation of a second aircraft intent description associated with the obtained trajectory represented in AIDL and finalizing the method.

2. The method of claim 1, wherein determining that the trajectory satisfies the trajectory specification threshold includes evaluating the trajectory by transforming and connecting combinations of the motion primitives.

3. The method of claim 2, wherein transforming and connecting the combinations of the motion primitives is based on the position of the aircraft associated with constructs of the trajectory.

4. The method of claim 3, further including determining a cost associated with the position of the aircraft.

5. The method of claim 3, further including determining viability of the position of the aircraft.

6. The method of claim 1, wherein one or more of the processes of c j are performed in substantially real time.

7. The method of claim 1, further including updating at least one of the information and the specifications without precomputed motion planning.

8. An apparatus for generating automated aircraft intent, comprising:

one or more processors configured to:

calculate a set of motion primitives associated with a first aircraft intent description and a position of an aircraft based on combinations of AIDL instructions, the motion primitives including steady-state conditions or maneuvers to bring an aircraft from one steady-state condition to another;

represent the motion primitives in AIDL;

collect information associated with at least one of 1) an aircraft performance model, 2) an environmental model, 3) a flight dynamic model, or 4) the motion primitives represented in AIDL;

initialize a finite state machine based on the collected information, the finite state machine being configured to concatenate motion primitives, wherein states of the finite state machine correspond to steady-state conditions and transitions between the states are defined by maneuvers;

collect specifications associated with at least one of: 1) flight plan instructions, 2) user preference indications, or 3) operational context indications;

represent the specifications in a first formal language;

combine the initialized finite state machine with the specifications represented in the first formal language to obtain a trajectory that satisfies a trajectory specification threshold;

determine whether the obtained trajectory satisfies the trajectory specification threshold;

iteratively initialize the finite state machine based on the information until a subsequently determined set of motion primitives satisfies the trajectory specification threshold, the subsequently determined set of motion primitives determined using incrementally modified motion primitives when the obtained trajectory is determined not to satisfy the trajectory specification threshold; and produce a representation of a second aircraft intent description of the obtained trajectory represented in AIDL when the obtained trajectory is determined to satisfy the trajectory specification threshold.

9. The apparatus of claim 8, wherein determining that the trajectory satisfies the trajectory specification threshold includes evaluating the trajectory by transforming and connecting combinations of the motion primitives.

10. The apparatus of claim 9, wherein transforming and connecting the combinations of the motion primitives is based on the position of the aircraft associated with constructs of the trajectory.

11. The apparatus of claim 10, wherein the one or more processors are to determine a cost associated with the position of the aircraft.

12. A non-transitory computer readable medium comprising instructions which, when executed, cause a machine to at least:

a) calculate a set of motion primitives associated with a first aircraft intent description and a position of an aircraft based on combinations of AIDL instructions, the motion primitives including steady-state conditions or maneuvers to bring an aircraft from one steady-state condition to another;

b) represent the motion primitives in AIDL;

c) collect information associated with at least one of 1) an aircraft performance model, 2) an environmental model, 3) a flight dynamic model, or 4) the motion primitives;

d) initialize a finite state machine based on the collected information, the finite state machine being configured to concatenate motion primitives, wherein states of the finite state machine correspond to steady-state conditions and transitions between the states are defined by maneuvers;

e) collect specifications associated with at least one of: 1) flight plan instructions, 2) user preference indications, or 3) operational context indications;

f) represent the specifications in a first formal language;

g) combine the initialized finite state machine with the specifications represented in the first formal language to obtain a trajectory that satisfies a trajectory specification threshold;

h) determine whether the obtained trajectory satisfies the trajectory specification threshold;

i) iteratively initialize the finite state machine based on the information until a subsequently determined set of motion primitives satisfies the trajectory specification threshold, the subsequently determined set of motion primitives determined using incrementally modified motion primitives when the obtained trajectory is determined not to satisfy the trajectory specification threshold; and j) produce a representation of a second aircraft intent description of the obtained trajectory represented in AIDL and finalizing the method when the obtained trajectory is determined to satisfy the trajectory specification threshold.

13. The computer readable medium of claim 12, wherein determining that the trajectory satisfies the trajectory specification threshold includes evaluating the trajectory by transforming and connecting combinations of the motion primitives.

14. The computer readable medium of claim 13, wherein the instructions, when executed, transform and connect the combinations of the motion primitives based on the position of the aircraft associated with constructs of the trajectory.

15. The computer readable medium of claim 14, wherein the instructions, when executed, determine a cost associated with the position of the aircraft.

16. The computer readable medium of claim 14, wherein the instructions, when executed, determine viability of the position of the aircraft.

17. The computer readable medium of claim 12, wherein the instructions, when executed, perform one or more of the processes of c j in substantially real time.

18. The computer readable medium of claim 12, wherein the instructions, when executed, update at least one of the information and the specifications without precomputed motion planning.

* * * * *